US007494337B2

(12) United States Patent
Specht et al.

(10) Patent No.: US 7,494,337 B2
(45) Date of Patent: Feb. 24, 2009

(54) APPARATUS AND METHOD FOR PROVIDING MULTIPLE STAGES OF FUEL

(75) Inventors: Werner Specht, Hermitage, PA (US); Steve Dunlap, Germantown, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 15 days.

(21) Appl. No.: 10/829,817

(22) Filed: Apr. 22, 2004

(65) Prior Publication Data

US 2005/0239006 A1 Oct. 27, 2005

(51) Int. Cl.
*F23D 15/00* (2006.01)
*F23D 14/02* (2006.01)

(52) U.S. Cl. ..... 431/283; 431/12; 431/60; 431/278; 431/280; 431/286; 126/116 R; 126/116 A

(58) Field of Classification Search ..... 431/6, 431/8, 12, 278, 280, 281, 283, 286, 60, 61; 126/116 R, 116 A; 236/15 R, 10, 11
See application file for complete search history.

(56) References Cited

U.S. PATENT DOCUMENTS

| | | | | | |
|---|---|---|---|---|---|
| 545,360 | A | * | 8/1895 | Hibberd | 239/553.5 |
| 1,135,840 | A | * | 4/1915 | Oudeville | 431/346 |
| 1,161,282 | A | * | 11/1915 | Bartlebaugh | 239/553.5 |
| 1,294,999 | A | * | 2/1919 | Brickman | 239/431 |
| 1,328,589 | A | * | 1/1920 | Roberts | 431/278 |
| 1,372,724 | A | | 3/1921 | Stine | |
| 1,500,513 | A | | 7/1924 | Merrill | |
| 1,568,771 | A | | 1/1926 | Roy | |
| 1,604,783 | A | | 10/1926 | Pickup | |
| 1,641,350 | A | | 9/1927 | Nieberding | |
| 1,642,153 | A | * | 9/1927 | Kemp | 431/180 |
| 1,642,154 | A | * | 9/1927 | Kemp | 239/417.5 |
| 1,744,439 | A | | 1/1930 | Bitgood | |
| 1,789,226 | A | | 1/1931 | Ensign et al. | |
| 1,830,464 | A | * | 11/1931 | Guenther | 431/285 |
| 1,910,020 | A | | 5/1933 | Le Boutillier et al. | |
| 1,935,705 | A | * | 11/1933 | Fuller | 431/346 |
| 2,100,995 | A | * | 11/1937 | Le Compte | 239/552 |
| 2,210,069 | A | | 8/1940 | Ensign | |
| 2,242,176 | A | | 5/1941 | Denise | |
| 2,251,710 | A | | 8/1941 | Livar | |
| 2,289,759 | A | * | 7/1942 | Denise | 126/110 B |
| 2,300,560 | A | * | 11/1942 | Faber | 236/1 E |
| 2,525,350 | A | | 10/1950 | Hanson | |

(Continued)

FOREIGN PATENT DOCUMENTS

| | | | |
|---|---|---|---|
| DE | 23 54 502 | * | 5/1975 |

(Continued)

*Primary Examiner*—Carl D Price
(74) *Attorney, Agent, or Firm*—Hoffmann & Baron, LLP

(57) ABSTRACT

The present invention provides an apparatus and method for providing multiple stages of fuel. A burner assembly having a face for production of a flame and a plurality of longitudinally adjacent chambers opening to the face. A divider is provided that splits the burner chambers into two separate sections in such a manner that one section includes burner chambers greater in number than the other section. The first section can be ignited solely. Thereafter, the second section can be ignited. Once the second section is ignited, the first section may be optionally turned off.

17 Claims, 3 Drawing Sheets

U.S. PATENT DOCUMENTS 2,560,862 A * 7/1951 Harrison ..... 239/553.5
2,607,405 A 8/1952 Weinandy
2,611,359 A 9/1952 Scogin
2,625,992 A * 1/1953 Beck ..... 431/283
2,626,656 A * 1/1953 Wyatt ..... 239/427
2,788,848 A * 4/1957 Furczyk ..... 239/429
2,807,320 A * 9/1957 Wilderman ..... 239/407
2,869,630 A * 1/1959 Flynn ..... 431/280
3,040,805 A 6/1962 Lambert
3,047,056 A 7/1962 Flynn
3,057,400 A 10/1962 Wagner
3,144,901 A * 8/1964 Meek ..... 96/144
3,241,544 A * 3/1966 Lohman ..... 126/116 R
3,552,378 A * 1/1971 Zavadsky et al. ..... 126/92 R
3,617,159 A * 11/1971 Arndt ..... 431/6
3,638,635 A 2/1972 Drennan
3,694,137 A * 9/1972 Fichter et al. ..... 431/283
3,935,855 A * 2/1976 van Vliet ..... 126/110 R
3,944,142 A 3/1976 Welden et al.
4,163,441 A * 8/1979 Chen ..... 126/116 A
4,305,372 A * 12/1981 Hahn ..... 126/41 R
4,348,170 A 9/1982 Vatsky et al.
4,400,151 A 8/1983 Vatsky
4,553,925 A 11/1985 Bricmont
5,011,400 A 4/1991 Vatsky
5,347,937 A 9/1994 Vatsky
5,368,476 A * 11/1994 Sugahara et al. ..... 431/285
5,408,943 A 4/1995 Vatsky
5,470,018 A * 11/1995 Smith ..... 236/15 A
5,568,777 A 10/1996 Breen et al.
5,601,071 A * 2/1997 Carr et al. ..... 126/116 A
5,724,897 A 3/1998 Breen et al.
5,795,145 A * 8/1998 Manning et al. ..... 431/280
6,015,101 A * 1/2000 Williamson et al. ..... 239/455
6,027,336 A 2/2000 Nolte et al.
6,036,481 A 3/2000 Legutko et al.
6,062,848 A 5/2000 Lifshits
6,109,255 A * 8/2000 Dieckmann et al. ..... 126/116 R
6,179,212 B1 * 1/2001 Banko ..... 236/1 E
6,179,608 B1 1/2001 Kraemer et al.
6,196,835 B1 3/2001 Gutmark et al.
2002/0155404 A1 * 10/2002 Casey et al. ..... 431/60
2003/0101983 A1 6/2003 Specht

FOREIGN PATENT DOCUMENTS

DE 3825629 A1 * 2/1989
DE 40 04 390 * 8/1990
DE 4004390 A1 * 8/1990
DE 19539869 A1 * 4/1997
EP 315579 A1 * 5/1989
EP 000781966 A1 * 7/1997
EP 000866270 A2 * 9/1998
EP 000930473 A2 * 7/1999
FR 2 800 847 * 5/2001
JP 01225812 A * 9/1989
JP 01-1310215 * 12/1989
JP 03-67918 * 3/1991
JP 04-6314 * 1/1992
JP 06-249415 * 9/1994
JP 06-257742 * 9/1994
JP 06249415 A * 9/1994
JP 06-288535 * 10/1994
JP 07-49117 * 2/1995
JP 07-198130 * 8/1995
JP 08-86416 * 4/1996
JP 08-200635 * 8/1996
JP 08-226616 * 9/1996
JP 08-291913 * 11/1996
JP 09-60974 * 3/1997
JP 09-96442 * 4/1997
JP 09-217901 * 8/1997
JP 10-38375 * 2/1998
JP 10-227413 * 8/1998
JP 2000-274667 * 10/2000
JP 2000-0274667 * 10/2000
JP 2000-291949 * 10/2000
JP 2002-005437 * 1/2002
JP 2002-71213 * 3/2002
JP 2003-65507 * 3/2003

* cited by examiner

APPARATUS AND METHOD FOR PROVIDING MULTIPLE STAGES OF FUEL

FIELD OF THE INVENTION

The present invention relates generally to an improved burner system and method for providing multiple stages of fuel. More particularly, the present invention relates to a multi-stage burner.

BACKGROUND OF THE INVENTION

Gas fired hot air furnaces have long been used to heat spaces in both residential and commercial setting. Most conventional gas fired furnaces include a plurality of heat exchangers spaced apart to allow air flow therebetween. The heat exchangers define an internal flow path for hot combustion gases supplied by burners. Heat transferred through the heat exchangers may be used to effect heating of a particular area. The furnace works by sending hot combustion gases through the heat exchangers and blowing room air over the heat exchangers so as to heat the air from the furnace into the area to be heated.

In order to control the air temperature of the hot air exiting the furnace and into the room, you control the temperature of the heat exchangers. This is typically done by controlling the hot combustion gases flowing through the heat exchanger. An increase or decrease in the combustion gases can be affected by controlling the combustion flame exiting the burner. A known burner arrangement is shown and described in U.S. patent application Ser. No. 10/299,479, filed Nov. 19, 2002, entitled "One Shot Heat Exchanger Burner", status of which is allowed. This application is published as US2003/0101983 A1 on Jun. 5, 2003, and incorporated by reference herein for all purposes.

As schematically shown in FIG. 1, this burner assembly includes a burner 10 defining a burner face 12. The burner face is spaced in close proximity to a plurality of heat exchangers 14. A gas air mixture is fed through a conduit 16 into the burner 10 where it is ignited at the front face 12 thereof. The flame 16 produces combustion gases which enter the heat exchanger as shown by arrows A. Room air may be blown across the heated heat exchangers as indicated by arrow B to heat the air exiting the furnace.

It may be appreciated that regulation or modulation of the fuel air mixture entering the burner can control the flame and thereby the temperature of the heat exchangers. It has been found that using burners of the type shown in FIG. 1 you can modulate a fuel air mixture at a 2:1 ratio, i.e., you can increase or decrease the fuel flow between 100% and 50% of capacity. Any attempt to regulate the fuel flow to less than 50% of capacity could result in combustion problems such as a generation of high CO levels. Thus, in conventional burners, an attempt to regulate the temperature of the heat exchangers so as to maintain exiting air temperature at a controlled set point temperature results in the need to frequently cycle the burner between an off and on position. Such frequent cycling results in a range or band width of the set point temperature being within an undesirable range of 10°.

To reduce such frequent cycling, the prior art has also seen the use of multiple burners in a single furnace. Multiple burners allow cycling among one or more burners so as to increase the modulation. However, the use of multiple burners in a single furnace is not a cost effective solution. Also, even in multiple burner situations, frequent on/off cycling results in heat exchangers seeing both hot and cold temperatures. When a heated heat exchanger cools, it forms undesirable condensation within the internal cavity of the heat exchanger. Any contaminants in the air, when condensed, can form acids which reduce the life of the heat exchanger.

It is, therefore, desirable to provide a fuel fired furnace which allows increased modulation without known undesirable effects and without the need to employ multiple burners in a single furnace.

SUMMARY OF THE INVENTION

The present invention provides an apparatus and a method for providing multiple stages of fuel. The apparatus includes a burner for production of a flame at a face of the burner; wherein the burner has a plurality of longitudinally adjacent burner chambers opening to the burner face. Also included are a plurality of heat exchangers positioned across the face of the burner to receive the flame. A divider is placed in the burner for dividing the burner chambers into a first section and a second section, wherein the second section includes the plurality of burner chambers being greater in number than the first section. Additionally, a first fuel supply line supplies fuel to the first section of the burner chambers and a second fuel supply line supplies fuel to the second section of the burner chambers, wherein the first supply line supplying fuel to the first section is independent of the supply line of the fuel to the second section by the second supply line. Further, an igniter is positioned at the burner face for igniting the fuel supplied by the first supply line to the first section of the chambers at the face.

In its method aspect, the present invention provides multiple stages of fuel to a furnace. A burner is divided into a first and second section. Air temperature is monitored to determine heating needs and fuel is supplied to at least one section of the burner independent of the supply to said other section. The fuel at the supplied section is ignited. The other or both sections may also be ignited depending upon the heating needs.

DETAILED DESCRIPTION OF THE PREFERRED EMBODIMENT

Figure 1:
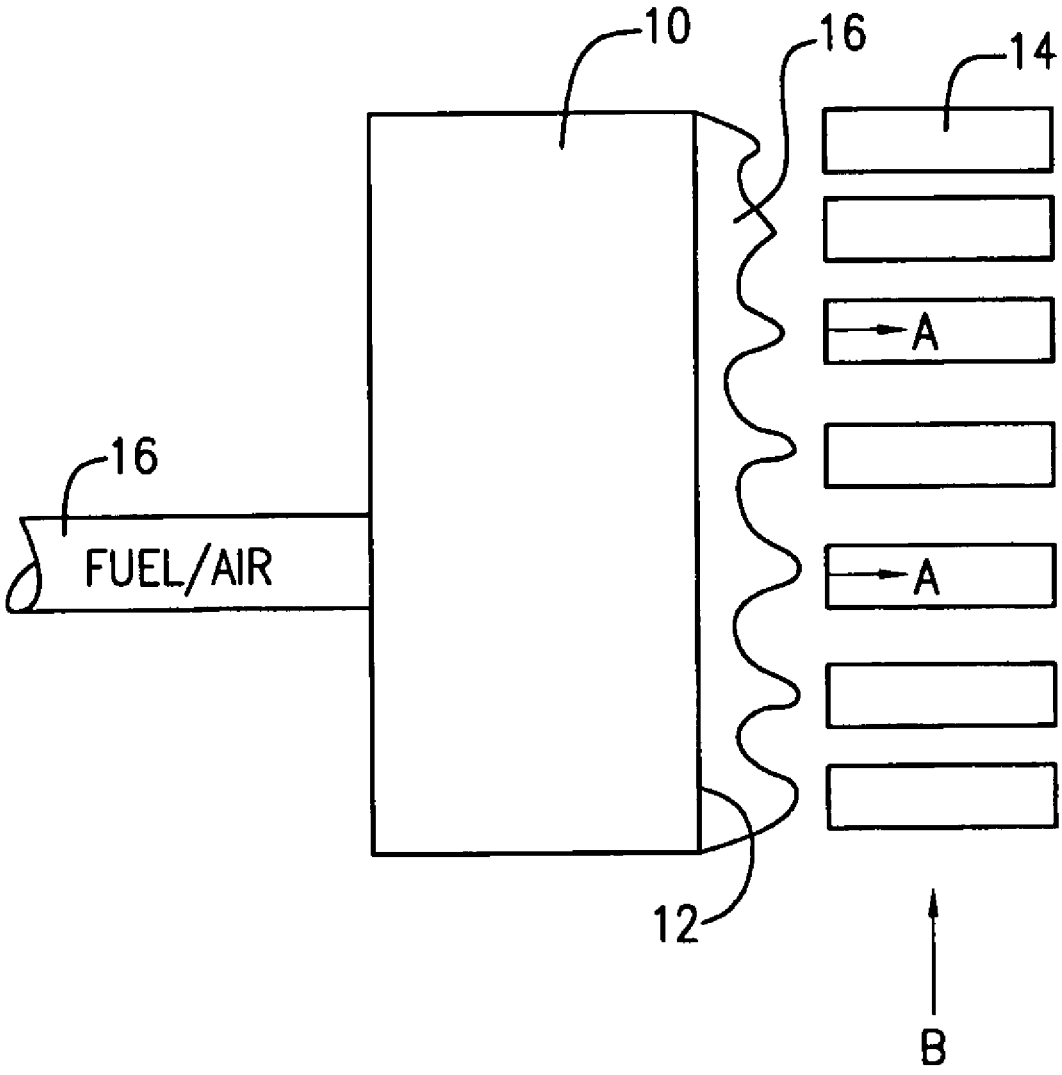
(PRIOR ART) FIG. 1
FIG. 1 is a schematic representation of a prior art burner system for use with a plurality of heat exchangers in a hot air furnace, with one burner being associated correspondingly with each heat exchanger.
Figure 2A:
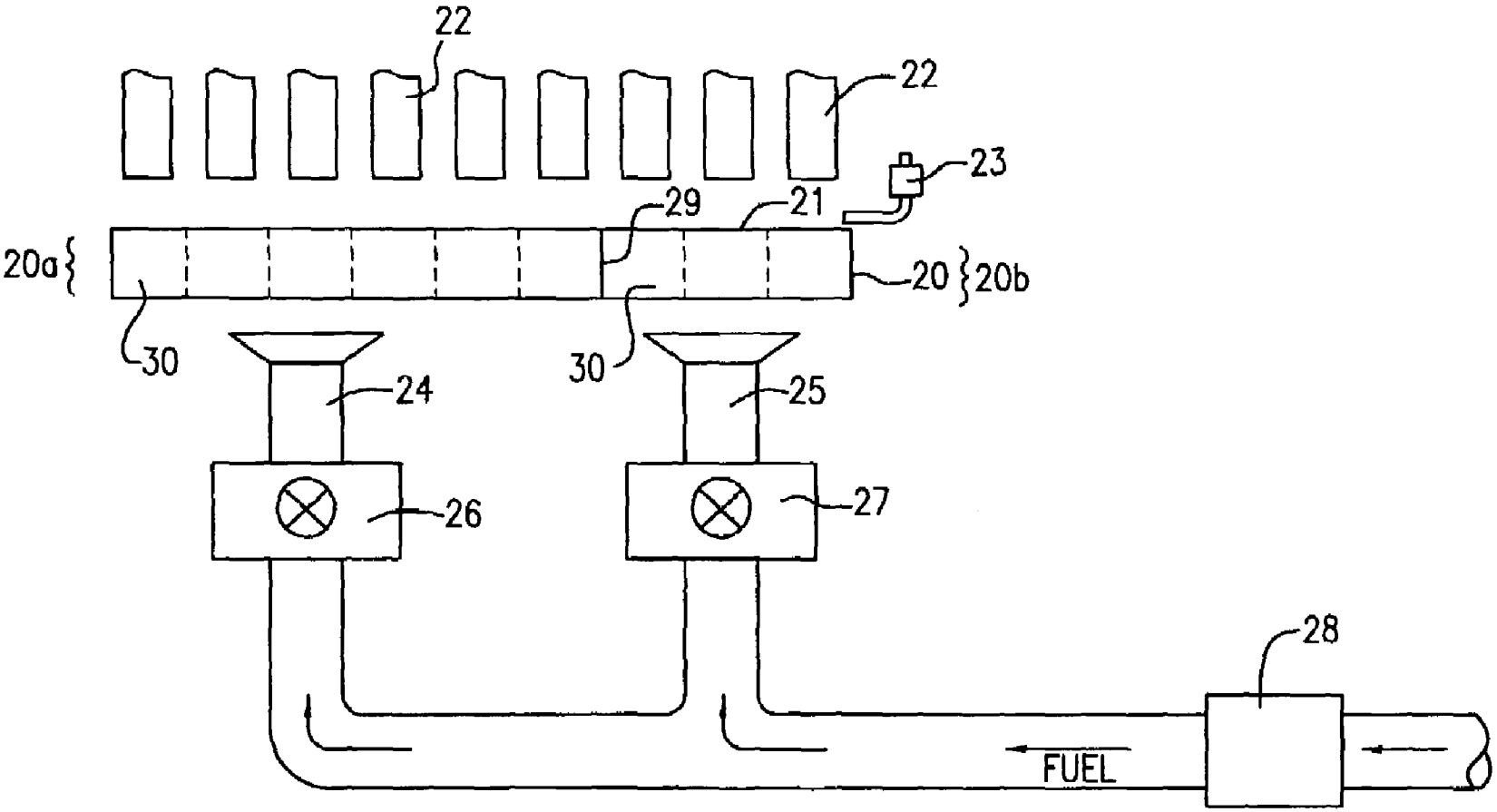
FIG. 2A is a schematic view of the fuel burner system of the present invention.

Referring to FIG. 2A, there is shown an apparatus/system for providing multiple stages of fuel having a single burner 20 for use with a plurality of heat exchangers 22.

The burner 20 includes a face 21 where the flame is produced. The burner 20 also includes plurality of longitudinally adjacent burner chambers 30 having one side of the openings at the face 21 and the other side of the openings connected to venturi tubes 24 and 25. The burner 20 is designed in such a manner that it preferably splits into two separate sections 20*a* and 20*b* with a divider 29. The divider 29 divides the burner 20 in such a manner that section 20*a* includes ⅔ of the total number of chambers in the burner 20 and section 20*b* includes ⅓ of the total number of chambers in the burner 20. Therefore, section 20 is able to hold and provide a ⅔ capacity of the gas and chamber 20*b* is able to hold and provide ⅓ capacity of the gas. Each of the sections of the burner 20*a* and 20*b* operate independent of each other as will be described in greater detail below.

A modulator 28 regulates the quantity of fuel being supplied to the burner sections 20*a* and 20*b* via the venture tubes 24 and 25 respectively. Venturi tube 24 acts as a fuel gas supply line for supplying fuel to the first section 20*a* and the venturi tube 25 is a fuel gas supply line for supplying fuel to the second section 20*b*.

Figure 2B:
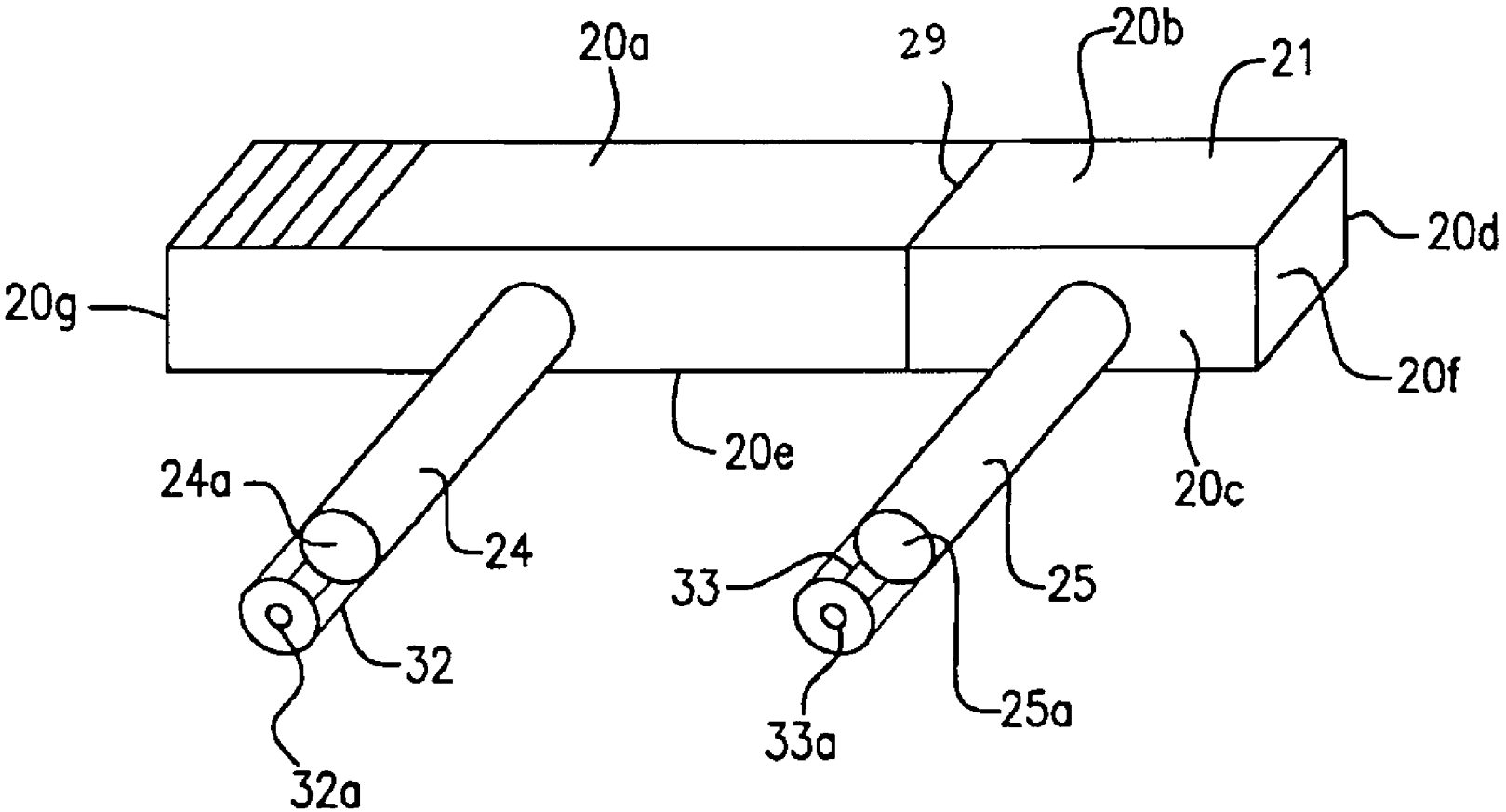
FIG. 2B is a top perspective view of the burner of FIG. 2A.

Referring now also to FIG. 2B, further details of the single burner 20 are described. Burner 20 includes a housing having an upper wall 20*c*, a lower wall 20*d*, a rear wall 20*e*, and two opposing sidewalls 20*f* and 20*g*. Burner face 21, defines the front wall of burner housing 20. Burner face 21 may preferably include a tray (not shown) having preferably a plurality of spaced fins desirably in ribbon fashion (not shown) or a plurality of individual fins (not shown) as shown in U.S. Patent Publication US2003/0101983 A1, the disclosure of which is incorporated by reference herein. These fins are formed of any suitable metal such as steel. Upper and lower walls 20*c* and 20*d*, rear wall 20*e* and burner face 21, and sidewalls 20*f* and 20*g* and the divider 29 define hollow mixing sections 20*a* and 20*b* of the burner 20 for air/gas mixture as will be described. The divider 29 extends between the sidewalls 20*f* and 20*g* completely separating the two chambers 20*a* and 20*b* from each other. Section 20*a* includes the entire side wall 20*g*, and ⅔ of upper and lower walls 20*c* and 20*d* and ⅔ of the burner face 21. Section 20*b* includes the entire side wall 20*f*, and ⅓ of the upper and lower walls 20*c* and 20*d* and ⅓ of burner face 21.

In the arrangement being described with respect to FIG. 2B, upper wall 20*c*, rear wall 20*e* and lower wall 20*d* are formed from a single sheet of suitable material, such as cold-rolled steel, and are suitably folded as shown using conventional metalworking techniques. Sidewalls 20*f* and 20*g* are also formed of suitable material, such as cold-rolled steel, and are joined to the upper wall 20*c*, lower wall 20*d*, and rear wall 20*e* by suitable fasteners.

Attached to upper wall 20*c* of burner housing 20 and projecting outwardly therefrom is a venturi tube 24. The venturi tube 24 is, in one particular arrangement, as shown in FIG. 2B, of generally cylindrical configuration having an interior opening 24*a* communicating with mixing section 20*a* of burner 20. Attached to the free distal end of venturi tube 24 is a bracket 32 defining a gas orifice 32*a*. Suitably attached to bracket 32 is a gas valve 26 shown in FIG. 2A for supplying gas into the venturi tube opening 32*a*. Air is also drawn into the venturi tube opening 32*a* for flowing into mixing section 20*a* and mixing with the supplied gas, as depicted in FIG. 2B. Venturi tube 25, as shown in FIG. 2B has a similar arrangement as that of venturi tube 24, however, venture tube supplies fuel to section 20*b*. Venturi tube 25 of generally cylindrical configuration has an interior opening 25*a* communicating with mixing section 20*b* of burner housing 20. A bracket 33 defining a gas orifice 33*a* is attached to the free distal end of venture tube 25. A gas valve 27 shown in FIG. 2A is attached to the bracket 33 for supplying gas into the venture tube opening 33*a*. Air is also drawn into the venture tube opening 33*a* for flowing into housing section 20*b* and mixing with the supplied gas, as depicted in FIG. 2B. While the supplied gas in the arrangement being described is natural gas, it should be understood that other fuels, including propane gas, may be used with the burner of the subject invention.

Referring again to FIG. 2A, the operation of the split burner in a gas-fired furnace is described. A support frame (not shown) is suitably secured to the burner housing 20 adjacent the burner face 21. The support frame is suitably secured to the furnace (not shown) such that the burner face 21 faces and is located adjacent to the clamshell heat exchangers 22. The support frame also functions as a secondary air shield around burner 20. An igniter 23 is supported at a location between burner face 21 and the heat exchangers 22. Igniter 23 is suitably wired to provide an electrical spark for igniting the air/gas mixture flowing through the fins (not shown) of burner face 21, as will be described.

In one embodiment of the present invention in operation, a three stage heating system is disclosed. In the first stage, under computer control modulation gas valve 28, fuel is supplied through valve 27 to venturi tube 25, where a quantity of air is also introduced. The supplied fuel and air mixture are drawn into the burner section 20*b* as a result of the suction pressure produced by an induction draft fan (not shown) which is connected to the exhaust ports of the heat exchangers 22. The air/fuel mixture drawn through the burner face 21 is ignited by igniter 23 causing combustion of the air/fuel mixture in the chambers of section 20*b*. As a result, only ⅓ section of the burner 20 i.e. only section 20*b* lights at high fire causing the heat gases to be forced preferably into the associated heat exchangers. At this stage, the burner is modulated between 50 to 100% of the ⅓ capacity of burner section 20*b*. The air temperature of the burner 20 is preferably monitored by a computer (not shown) for heating the temperature of heat exchanges 22 so as to monitor exiting air temperature at a controlled set point temperature. The temperature is controlled or regulated by modulating the gas valve/pressure into venturi tube 25. If more heat is needed to meet set point temperature, valve 28 is opened to allow an additional flow of fuel. If still more heat is needed to meet set point temperature, valve 26 is opened in the second stage. The fuel flows into the venture tube 24 and is mixed with air. The air/fuel mixture is drawn into the chamber of burner section 20*a*, which picks up the flame from the burner section 20*b*. The gas pressure is maximum during this interval to assure flame carry over to the burner section 20*a*, which occupies ⅔ of the burner capacity. In this second stage, the burner is modulated between 50% to 100% of the ⅔ capacity of the burner section 20*b*. The heat gas from the chambers 30 of burner chamber 20*a* is forced into the heat exchangers 22. At this time, the burner 20 is running at full capacity with gas being provided by chambers 30 of both sections 20*a* and 20*b*. However, if only ⅔ capacity of the gas is required, burner section 20*b* can be turned off by the valve 27. A period of 20 second delay is required to assure flame carry over prior to disabling the burner section 20*b*.

In another case scenario, while the burner section 20*a* remains active, when the heating set point is satisfied, there may preferably be no need to keep the burner section 20*a* (of ⅔ capacity) active. At this point, valve 27 is opened. Again, the gas pressure is maximum at this interval to assure flame carry over from burner section 20*a* to 20*b*. Both burner sections 20*a* and 20*b* remain enabled and the burner 20 is running at full capacity for about twenty seconds. After the twenty second cycle interval, valve 26 is closed, thereby disabling the burner chamber 20*a*.

The third stage of the heating system occurs when both valves 26 and 27 are opened and both the burner sections 20*a* and 20*b* are providing gas to the heat exchangers 22. This case scenario occurs when 100% capacity of the ⅔ section of burner 20*a* is not enough to heat the heat exchanger 22. In this third stage, burner 20 is modulated to 50 to 100% of the ⅔ or full capacity of the burner 20.

Therefore, you can now control the heat at the heat exchangers 22 by modulating the temperature of the combustion gas into the heat exchanger 22. This method is unique in that each burner is only modulated to 50% of capacity while maintaining gas thermal efficiencies. You can use ⅓, ⅔ or ⅔ capacities of a single split burner to provide 6:1 gas modulation as shown in Table 1 herein below.

TABLE 1

| Active Burner | % Modulated | Total Modulation |
|---|---|---|
| Burner 20b(⅓) | 50% | 50% of ⅓ = ⅙ |
| | 100% | 100% of ⅓ = ⅔ |
| Burner 20a(⅔) | 50% | 50% of ⅔ = ⅔ |
| | 100% | 100% of ⅔ = ⅔ |
| Burner 20a & | 50% | 50% of ⅔ = ⅔ |
| Burner 20b(⅔) | 100% | 100% of ⅔ = ⅔ |

It should now be appreciated that the single split burner design arrangement, as described herein, provides significant advantages over the conventional multiple burner configurations. For example, an increased modulation can be obtained utilizing only one single burner. Also, cost savings may be realized as a result of the elimination of the gas manifold used in the multiple burner arrangement as well as a reduction in the number of independent burners. In addition, the single burner replaces multiple orifices with a single orifice that more effectively meters the proper amount of combustible air/gas mixture flowing through the burner face. Furthermore, the undesirable condensation is greatly reduced due to less cycling between hot/cold in heat exchangers.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. An apparatus for providing multiple stages of fuel, comprising:

a single burner for production of a flame at a burner face, said burner comprises:

a housing having an upper wall, a lower wall, a rear wall, two opposing sidewalls and said burner face, said burner face is defined by said opposing sidewalls, said upper wall and said lower wall;

a divider within said housing to divide said housing into a first section and a second section, said first section and said second section operate independent from each other; and a plurality of identical burner chambers within said first section and within said second section, said burner chambers being longitudinally adjacent and opening to said burner face, said plurality of burner chambers of said second section being greater in number than said plurality of burner chambers of said first section;

a plurality of heat exchangers positioned adjacent face of the burner to receive said flame;

a first fuel supply line for supplying fuel to said first section of said burner chambers, said first fuel supply line attached to said upper wall;

a second fuel supply line for supplying fuel to said second section of said burner chambers, said second fuel supply line attached to said upper wall, wherein said first supply line supplying fuel to said first section is independent of the supply of said fuel to said second section by said second supply line; and an igniter positioned at said burner face for igniting said fuel supplied by said first supply line to said first section of chambers at said face.

2. The apparatus of claim 1 wherein said fuel supplied to said second section of chambers being ignitable at said face thereof upon said independent supply of said fuel from said second supply line without an additional igniter.

3. A burner of claim 2 wherein the number of burner chambers of said second section is twice that of said first section.

4. The burner of claim 3 wherein said burner chambers are connected to a venturi tube.

5. The apparatus of claim 1 wherein the ignited fuel of the first section at said face ignites the fuel supplied by said second supply line to said second section at said face.

6. The apparatus of claim 5 where the ignited fuel of said first section is extinguished after said second section is ignited.

7. The apparatus of claim 1 further includes a modulator gas valve regulating the fuel supplied to said first and second sections via said first and second fuel supply lines respectively.

8. A burner of claim 1 wherein said igniter is located adjacent said face of said first section of said burner chambers.

9. The burner of claim 1 wherein said first fuel supply line is directly connected to said first section and said second fuel supply line is directly connected to said second section.

10. The apparatus of claim 1 wherein the divider divides one-third of the housing into said first section and two-thirds of the house into said second section, said first section is adjacent said second housing.

11. A method for providing multiple stages of fuel, comprising:

providing a single burner for production of a flame at a burner face, said burner includes an upper wall, a lower wall, a rear wall, two opposing sidewalls, and said burner face, said burner face is defined by said opposing sidewalls, said upper wall and said lower wall;

dividing said burner with a divider into a first section and a second section, wherein said first section is defined by a portion of said burner face, a portion of said upper wall, one of said sidewalls, a portion of said rear wall, a portion of said lower wall and said divider, wherein said second section is defined by another portion of said burner face, another portion of said upper wall, said other of said sidewalls, another portion of said rear wall, another portion of said lower wall and said divider, wherein said second section is larger than said first section, said first section functioning independently from said second section;

dividing said first section into a plurality of chambers;

dividing said second section into a plurality of chambers;

controlling the supply of said fuel to at least one of said first and second sections in response to said heating needs;

supplying fuel to at least one of said sections, wherein the fuel supplied to each of the sections is independent of each other;

producing suction pressure which draws supplied fuel and an air mixture into the burner chambers, and igniting said fuel at said at least one of said sections for producing flames at said face.

12. The method of claim 11 wherein said second section is supplied with fuel in response to an increase in said heating needs.

13. The method of claim 11 wherein said fuel supplied to the first section is ignited by an igniter.

14. The method of claim 13 wherein fuel supplied to the second section is ignited by the ignited fuel of the first section.

15. The method of claim 14 further comprising:

stopping the fuel supplied to said first section after said second section has been ignited.

16. The method of claim 15 wherein a delay is provided for stopping the fuel supplied to said first section.

17. A multi-stage burner system for a fuel fired furnace comprising:

a single burner for production of a flame at a face of said burner, said burner including a divider dividing said burner into a first section and second section, said first section and said second section are hollow mixing chambers, said second section being larger than said first section, a plurality of identical burner chambers within the first section and a plurality of identical burner chambers within the second section;

a fuel supply line for independently supplying fuel to said first section and said second section;

an igniter for igniting said fuel at said first section;

control means coupled to said supply line for controlling the supply of said fuel to said first and second section in response to heating needs;

said control means supplying fuel to said first section and subsequently supplying fuel to said second section in response to an increase in said heating needs; said control means stopping supply of said fuel to said first section after said fuel supply to said second section has been ignited by said ignited fuel of said first section.

* * * * *